US005841678A

United States Patent [19]

Hasenberg et al.

[11] Patent Number: 5,841,678

[45] Date of Patent: Nov. 24, 1998

[54] MODELING AND SIMULATION OF A REACTION FOR HYDROTREATING HYDROCARBON OIL

[75] Inventors: Daniel M. Hasenberg; Joseph F. Campagnolo, Jr., both of Bartlesville, Okla.

[73] Assignee: Phillips Petroleum Company, Bartlesville, Okla.

[21] Appl. No.: 785,467

[22] Filed: Jan. 17, 1997

[51] Int. Cl.[6] ..... G06G 7/58

[52] U.S. Cl. ..... 364/578; 364/149

[58] Field of Search ..... 364/578, 148, 364/149, 150, 151, 500, 501, 502; 208/46, 106, 142; 585/250

[56] References Cited

U.S. PATENT DOCUMENTS

| | | | |
|---|---|---|---|
| 3,828,171 | 8/1974 | Griffin | 235/151.12 |
| 4,975,827 | 12/1990 | Yonezawa | 364/151 |
| 5,059,303 | 10/1991 | Taylor et al. | 208/96 |
| 5,076,909 | 12/1991 | Overfield et al. | 208/177 |
| 5,132,918 | 7/1992 | Funk | 364/501 |
| 5,186,818 | 2/1993 | Daage et al. | 208/254 H |
| 5,341,313 | 8/1994 | Parrott et al. | 364/578 |
| 5,496,464 | 3/1996 | Piskorz et al. | 208/108 |

OTHER PUBLICATIONS

Liptah, B.G., "Instrument Engineers Handbook", vol. 1, pp. 1001–1002.

*Primary Examiner*—Kevin J. Teska
*Assistant Examiner*—Matthew Loppnow
*Attorney, Agent, or Firm*—George E. Bogatie

[57] ABSTRACT

A computer implemented method for modeling and simulating a hydrotreating reactor is disclosed where a first step in the simulation utilizes a computer data base of reaction kinetic parameters for hydrotreating sulfur and metals contaminated residuum and gas oil fractions. The data base is extended to include parameters and physical properties for residuum and gas oil fractions that are obtained from several different source locations. A group of equations, which are functions of catalyst properties, reactor parameters and feedstock composition, models the reaction by predicting yields, hydrogen consumption, contaminant levels, and physical properties of the reactor product. The simulation adjusts the kinetic parameters for reaction conditions to be simulated, such as temperature, catalyst activity, hours on stream, space velocity etc., and solves the model equations for the desired results. The simulation is particularly useful for evaluating a slate of crude oils to aid in selecting an economical crude oil for future processing in a refinery.

19 Claims, 7 Drawing Sheets

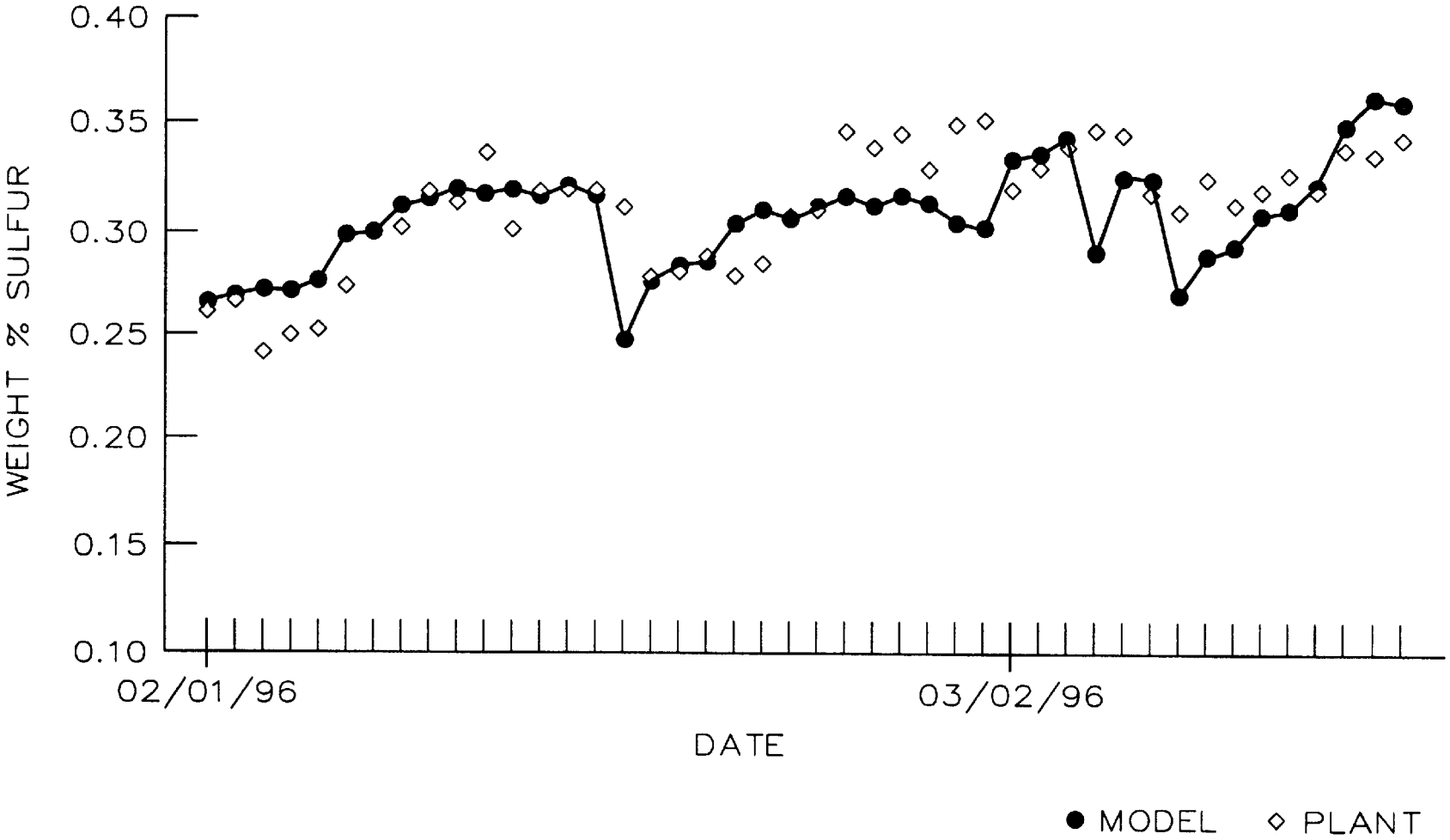
*FIG. 3(α)*

MODELING AND SIMULATION OF A REACTION FOR HYDROTREATING HYDROCARBON OIL

This invention relates to refining of hydrocarbon distillation residuum oil fractions, and more particularly to computer operations for modeling and simulation of a reaction process used for desulfurization and demetalization of the residuum fractions. In another aspect it relates to a method for enhancing selection of an economically attractive crude oil for future processing from an available slate of crude oils.

BACKGROUND OF THE INVENTION

Hydrocarbon oils containing sulfur and metal contaminants exist abundantly in nature. For example, certain crude oils produced in South America, heavy oils extracted from oil sand produced in Canada, Middle and Near East oils, etc., usually contain significant quantities of metals such as iron, nickel, and vanadium, and also contain sulfur compounds, nitrogen compounds and the like. Table I shows properties of typical heavy hydrocarbon crude oils. In the table the letters A thru F respectively indicates the origin of the following oils:

TABLE I

| | Properties of Typical Crude Oils | | | | | |
|---|---|---|---|---|---|---|
| | A | B | C | D | E | F |
| Specific gravity, API | 9.4 | 9.2 | 5.1 | 4.8 | 6.0 | 16.4 |
| Carbon, wt. % | 83.06 | 83.11 | 83.11 | 89.85 | 83.42 | 85.35 |
| Hydrogen, wt. % | 10.9 | 10.50 | 10.05 | 10.36 | 10.12 | 11.50 |
| Sulfur, wt. % | 5.36 | 4.41 | 5.24 | 3.67 | 5.25 | 2.62 |
| Nitrogen, wt. % | 0.58 | 0.42 | 0.40 | 0.65 | 0.42 | 0.36 |
| Conradson carbon residue, wt. % | 15.8 | 13.5 | 23.8 | 21.6 | 23.0 | 8.88 |
| Asphaltenes, wt. % | 11.8 | 8.1 | 14.6 | 7.8 | 4.9 | 2.87 |
| Metals, ppm wt. | | | | | | |
| Ni | 106 | 79 | 53 | 92 | 35 | 42 |
| V | 1240 | 182 | 165 | 298 | 117 | 130 |

A: Boscan crude oil
B: Athabasca bitumen
C: Khafji vacuum residue
D: Gach Saram vacuum residue
E: Kuwait vacuum residue
F: Gach Saran atmospheric residue Many different process steps are used in refining oils such as distillation, visbreaking, desulfurization, demetalization, cracking, hydrogenation, extraction, etc., to produce a desired product such as gasoline. In a typical sequence of processes, crude oil is first fed to an atmospheric crude unit, conventionally used in the petroleum refining art, in which the crude oil is subjected to atmospheric fractional distillation. The atmospheric residuum are the heaviest fraction resulting from such distillation and is enriched in coke precursors, sulfur, and heavy metals such as iron, nickel and vanadium. This residuum fraction and optionally gas oil are then fed to a hydrotreater, such as an atmospheric residuum desulfurization (ARDS) unit, which accordingly hydrotreats the residuum in the presence of a supported metal sulfide catalyst at a temperature of about 600° F. to 800° F. The desulfurized ARDS products are then separated into various fractions, some of which may be processed in a catalytic cracker unit to produce lighter hydrocarbon products.

Various kinds of catalysts and desulfurization processes have been proposed for hydrotreating heavy oil fractions having a relatively high heavy metal content to obtain a higher grade of desulfurized oil. A typical process employs a fixed or ebullated bed to remove sulfur and nitrogen directly by a catalytic reaction to form $H_2S$ and $NH_3$. In one commercial process, such as the previously mentioned ARDS process, active catalysts are employed in fixed beds with continuous oil flow through the reactor for removal of sulfur, nitrogen and metals such as iron, nickel and vanadium from residuum oils.

It is, however, well known among those of ordinary skill in the art of petroleum refining, that a number of economical disadvantages may result from the above described hydrotreating process if the oil to be treated contains large amounts of either metals or asphaltenes. It is believed that asphaltenes or macromolecules associated with the metals are colloidally dispersed in the oil and are not able to diffuse easily into the active sites in the pores of the catalyst. Accordingly, the presence of these macromolecules inhibits desulfurization and other reactions for hydrotreating the hydrocarbon oil. Another obstacle to the practical application of the direct hydrodesulfurization process lies in the formation of coke and carbonaceous material leading to sharp reduction in the activity of the catalyst. If the feedstock oil for the hydrotreater contains large amounts of metal and also contains coke forming precursors, a gummy carbonaceous material unites the catalyst particles together. This material causes plugging of the catalyst bed, and other serious problems such as maldistrubution of the reactant oil flowing through the bed and an increased differential pressure across the bed.

Accordingly, it would be highly desirable to predict how well a specific crude oil would run in the hydrotreating process. Thus, providing guidance to refiners in evaluating crude oil feedstocks selected for future processing in the refinery.

It is an object of this invention to accurately predict physical properties, sulfur and heavy metal contaminant levels of catalytically hydrotreated oils.

It is a more specific object of this invention to model and simulate a continuous ARDS reaction process in a computer, where the reaction process is simulated over a desired time period.

Another object is to create a data base containing reaction kinetic parameters for use in reaction rate equations, which are unique to residuum fractions of each specific crude oil.

Other objects and advantages of the invention will be apparent to those skilled in the art from the following description of the preferred embodiment and the appended claims and the drawings in which:

SUMMARY OF THE INVENTION

Figure 1:
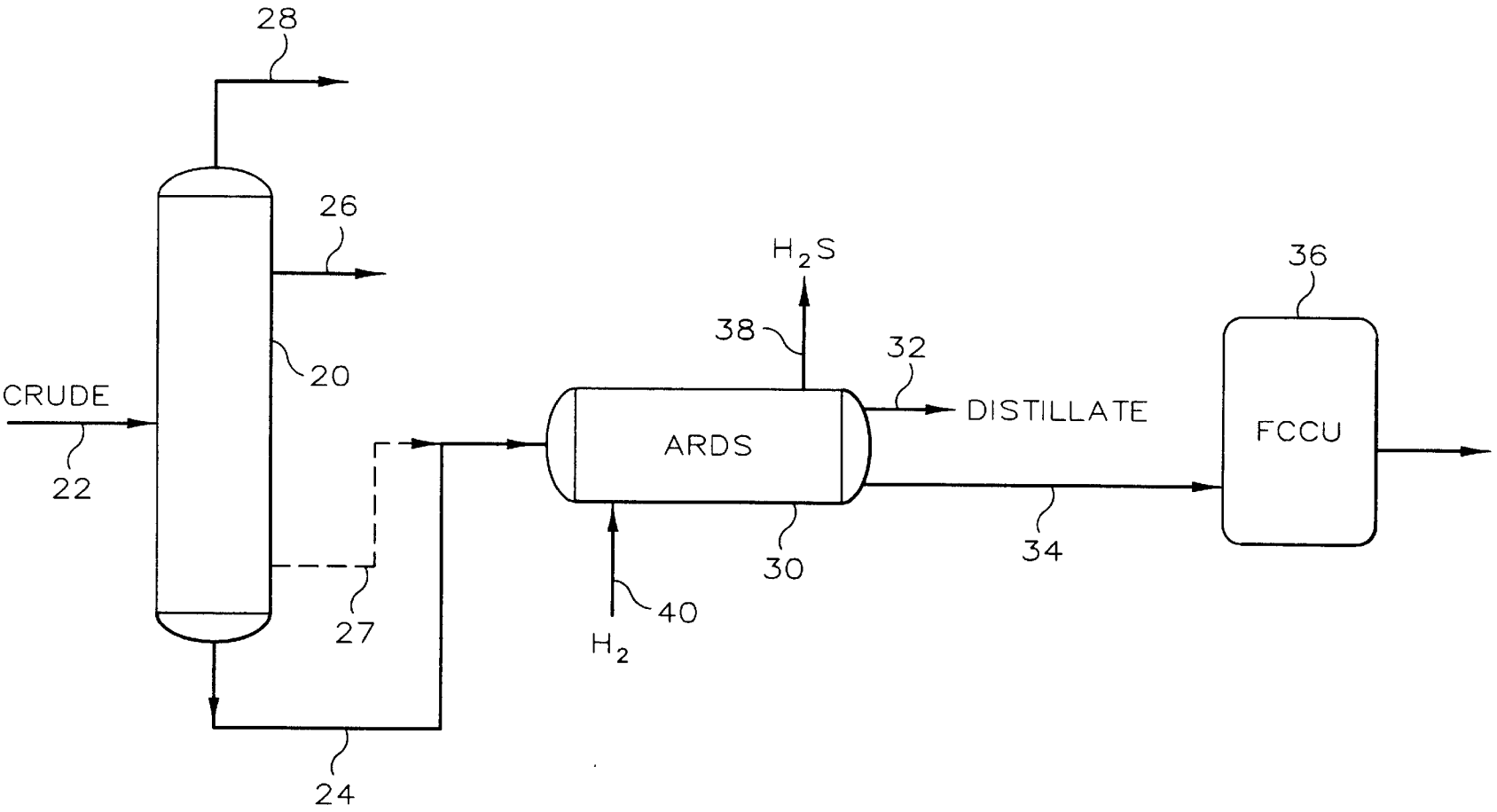
FIG. 1 is a simplified refinery flow diagram illustrating desulfurization of a residuum fraction and a gas oil fraction from an atmospheric crude distillation.

According to the present invention, the foregoing and other objects and advantages are attained with the aid of a computer programmed for simulating reactions associated with hydrotreating residuum crude oil fractions. In use, hydrotreating of a slate of candidate oils can be simulated, and the simulation results for each residuum fraction, which are computed over a significant time period, can be compared. This comparison enhances selection of an economically attractive crude oil for future hydrotreating from an available slate of crude oils. Simulation is carried out by providing the computer with a data base containing chemical reaction kinetic parameters, which are unique to each candidate oil, for simulating hydrodesulfurization (HDS) and hydrodemetalization (HDM) of residuum oil fractions. The data base also contains physical properties including levels of contaminants for the various fractions of the residuum oil to be simulated. Further, the computer is provided with reactor process conditions at which the simulation is to be carried out. Having information available from the data base as well as other data provided to the computer, calculations are made for the values of variables that are relevant to the objective of the simulation.

In a preferred embodiment for simulating HDS and HDM of the atmospheric residuum fraction of a crude oil, the data base includes values for variables, unique to each candidate oil. Also data for mixtures of various quantities of several candidate oils can be reported. The data base includes reaction kinetic parameters for: (a) conversion of sulfur to hydrogen sulfide; (b) hydrogen incorporated into the residuum; (c) removal of Conradson carbon; and (d) removal of nickel and vanadium. In addition, the data base contains distillation curve data and values for contaminant levels and physical properties of the residual fractions of distilled crude oil. The simulation includes intermediate calculations for adjusted kinetic rate constants for each candidate oil being simulated. Then output calculations yield the level of contaminants remaining in the hydrotreated residuum oil, and physical properties of the treated residuum oil. Additional computations include: production rate of hydrogen sulfide gas, production rate of light hydrocarbon gases, chemical hydrogen consumption, metals deposited on the catalyst, the basic nitrogen content in the hydrotreated oil, and the wt % hydrogen in the hydrotreated oil. The following physical properties of hydrotreated oil are also calculated: API gravity, refractive index, and viscosity of the hydrotreated residuum.

DETAILED DESCRIPTION OF THE INVENTION

Hydrodesulfurization reactions are typically carried out in fixed-bed catalytic reactors, where an oil feed is mixed with a hydrogen rich gas either before or after it is preheated to the desired reactor inlet temperature. Most hydrotreating reactions are carried out below 800° F. to minimize cracking and the feed is usually heated to between 500° and 800° F. The oil feed combined with the hydrogen rich gas enters the top of the fixed bed reactor and flows down through the catalyst bed. In the presence of the catalyst, hydrogen reacts with the oil to produce hydrogen sulfide gas and also reacts to produce ammonia gas. Desulfurized products and other hydrogenated products are also produced. The reactor effluent then enters a separator which removes the hydrogen rich gas from the desulfurized oil. The desulfurized oil is stripped of remaining hydrogen sulfide and ammonia in an amine stripper. The hydrogen gas can be treated to remove any remaining hydrogen sulfide and can be recycled to the reactor. The hydrodesulfurization feedstock contemplated in the present invention is either a residuum fraction from an atmospheric crude distillation boiling above 650° F. or a vacuum crude distillation boiling above 750° F.

The presence of lower boiling fractions, specifically atmospheric gas oil in a boiling range of 500° to 650° F., combined with the hydrotreater feed is also contemplated.

Referring now to FIG. 1, there is illustrated a well known combination of refinery units for refining crude oils to desired products. The facility includes a crude distillation column 20, which receives a crude oil feedstream via conduit 22. As is well known in the art, crude units may be operated to produce a variety of cuts including kerosene, light and heavy gas oils, etc. Crude is typically fed to the atmospheric distillation column unit 20 at a rate of about 75,000 to 200,000 barrels per day. In the atmospheric distillation unit, the crude oil is fractionated into an atmospheric residuum boiling above 650° F., which is removed from the distillation unit via conduit 24. Other lower boiling fractions are removed via conduit such as 26, and the overhead gaseous fraction removed via conduit 28. Fractions removed from conduit 26 and 28 are conserved for further processing and play no part in the explanation of the present invention. If desired the atmospheric gas oil in conduit 27 can be combined with the hydrotreater feed in conduit 24, which is shown as a dashed line in FIG. 1.

The atmospheric distilled residuum flowing in conduit 24 passes to an ARDS reactor unit 30, in which the residuum is subjected to a catalytic reaction for the purpose for removing sulfur, Conradson carbon residue, nitrogen, and metals, primarily including nickel and vanadium. The desulfurized distillate, which boils below 650° F., is removed from the ARDS reactor 30 via conduit 32 and is conserved for further processing. Decontaminated residuum oil in conduit 34 is typically passed to a cat cracker unit for upgrading.

Hydrogen, generated from an outside source such as a natural gas hydrogen plant is directed through conduit 40 to the ARDS reactor 30 where it is mixed with residuum oil supplied via conduit 24. Also removed from the ARDS reactor 30 via conduit 38 are product gasses of hydrogen sulfide and ammonia.

The description of the process in FIG. 1 described to this point is conventional. It is the modeling and simulation of the ARDS reactor that provides the novel features of this invention.

Development of Reaction Model

It is generally known that organic sulfur and nitrogen compounds contained in a hydrocarbon feedstock can be hydrodesulfurized. In accordance with one aspect of this invention a mathematical model is defined for predicting removal of sulfur, Conradson carbon, and metal contaminants from a residuum, with further predictions of physical properties of the hydrotreated/decontaminated residuum oil, and chemical hydrogen consumption in the reaction. The model is based on fundamental chemical laws of total and component mass balances as applied to a network of simultaneous and/or consecutive reactions between hydrogen gas and liquid oil in the presence of a catalyst, and is expressed as a group of equations. Chemical kinetic parameters are required in the model for reactions effecting sulfur, Conradson carbon residue, and metals removal, and hydrogen incorporation. These reaction kinetics parameters are predetermined from experimental laboratory reaction data, for each residuum feedstock to be simulated. These kinetic parameters and residuum oil properties are entered into a data base that can be accessed by the simulation program.

Assumptions are made that the rate of ARDS reaction is a function of catalyst properties, reaction process variables and initial feedstock composition. Also it is assumed that the hydrotreating reactions are irreversible. Further assumptions include uniform flow, constant hold up of reactants, constant catalyst volume, and perfect mixing of the hydrogen gas in the liquid feedstock. The kinetic model further incorporates equations that account for catalyst aging with resulting catalyst deactivation. Deactivation is based upon the time on stream or equivalently barrels of flow over the catalyst for a particular bed. Still further, computations are made for predicting physical properties of ARDS products, such as API gravity and boiling point data for the hydrotreated residuum.

Computer Simulation

For simulating a chemical hydrotreating reaction in a suitable digital computer, the group of equations called a model, along with a data base including reaction kinetic parameters, and initial input data that defines physical properties of feedstocks, are stored in the computer memory. Solution of the model equations responsive to initial data, which typifies a particular oil feedstock, and kinetic parameters adjusted for simulated reaction conditions, then predicts properties of the reaction products that would be obtained from hydrotreating the feedstock. Accordingly, by changing the initial input data of the model and/or simulated reaction conditions, one can draw inferences about actual reaction products corresponding to the various feedstocks without making the product.

A number of high level computer programming languages have been developed that facilitate mathematical applications. One such language, which is well known, is FORTRAN. The nature of FORTRAN enables one to easily express and solve mathematical equations. FORTRAN language is available on many different computer systems, and is preferably used in the practice of this invention where many numerical calculations are required.

Another program which is well known and suitable for use in this invention is called LOTUS 1-2-3. This program has capacity to execute many commands and also runs on many different computer systems. It is particularly effective for handling data base files and electronic spreadsheet models where calculations involve a table of numbers arranged in rows and columns.

The predictive capability of the model, according to the invention, can be used to predict yields for the feedstocks used in determining the reaction rate constants included in the data base.

Figure 2:
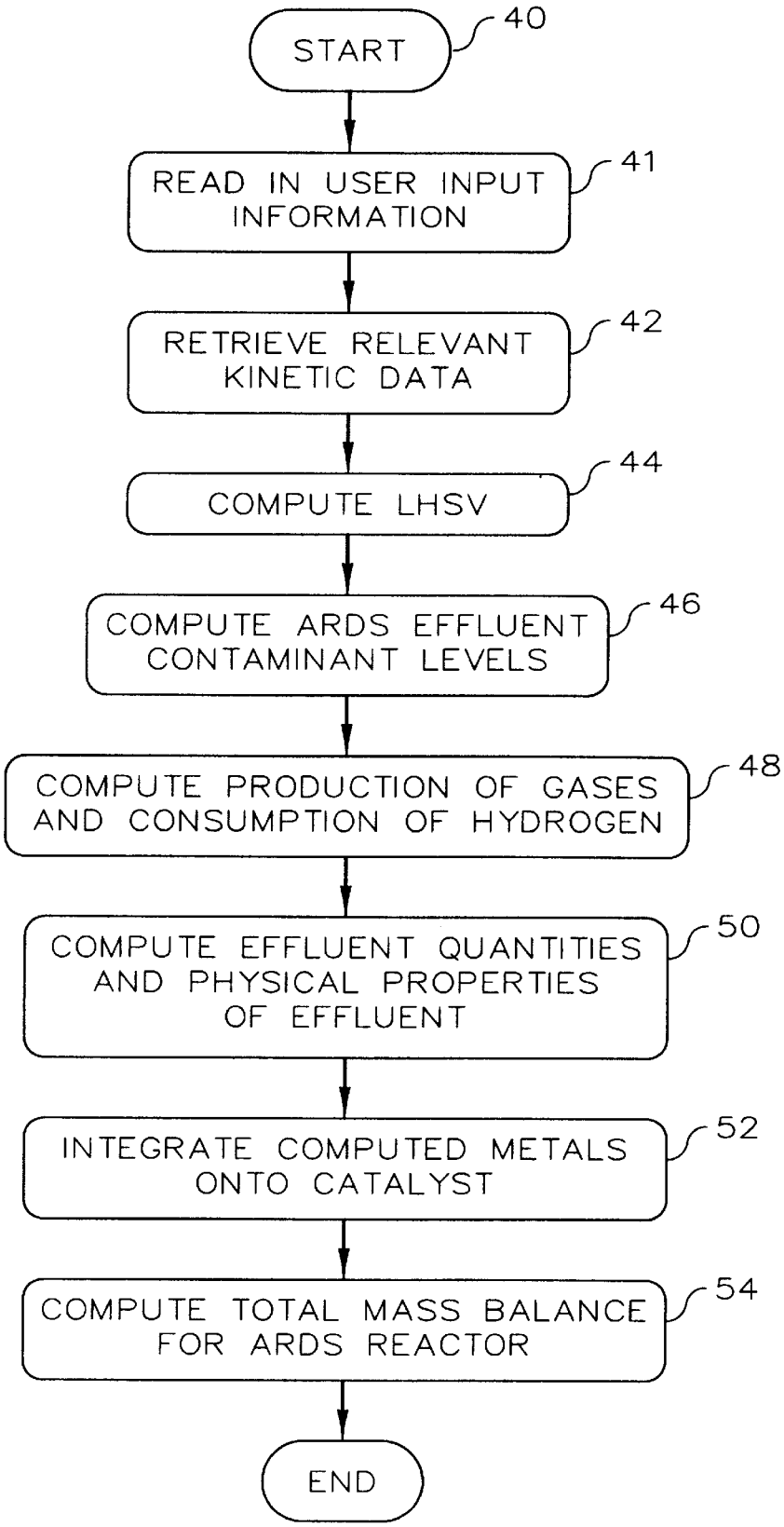
FIG. 2 is a computer program flow chart according to the present invention.
Figure 3B:
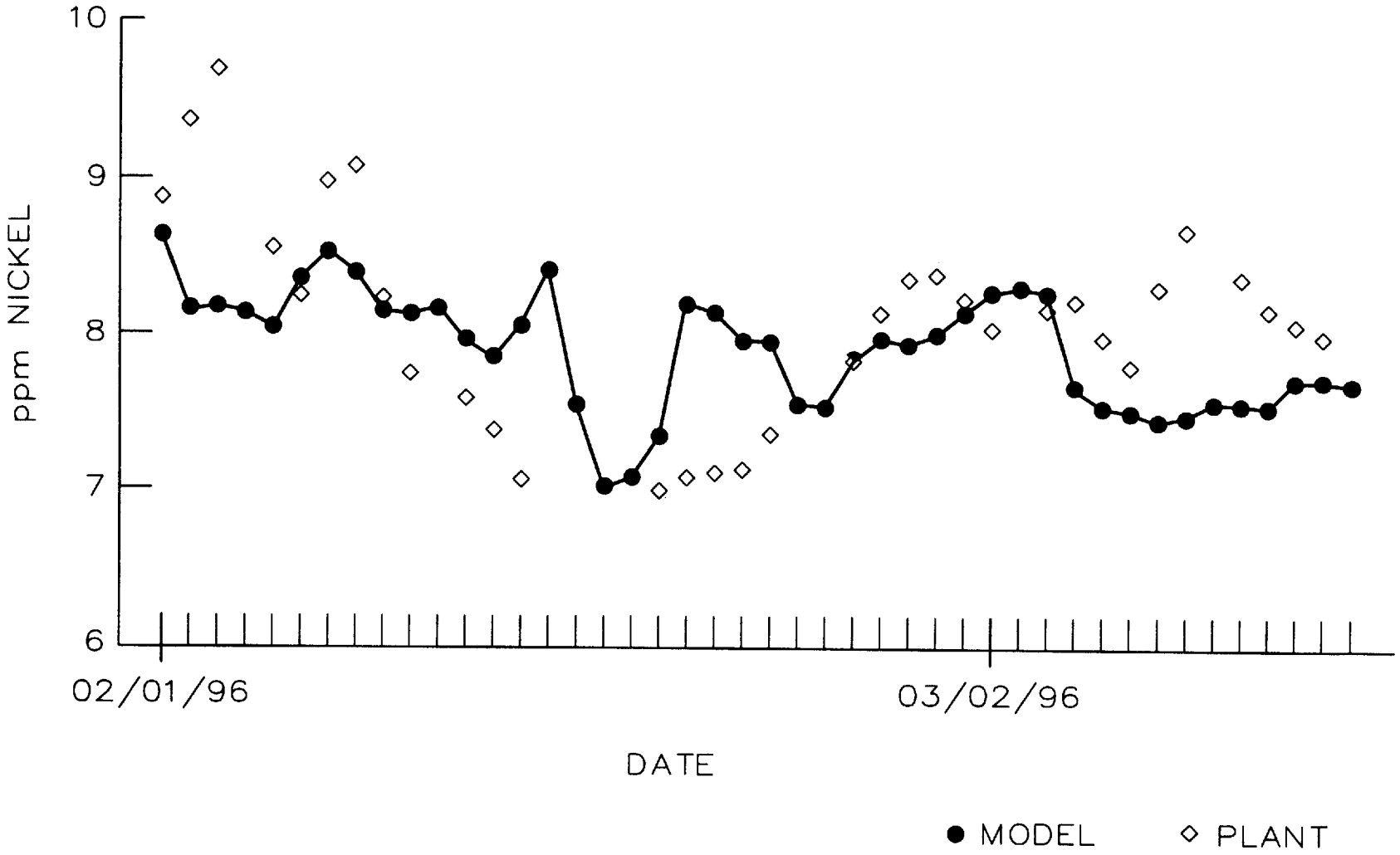
FIGS. 3(*a*)–3(*e*) are computer generated graphs comparing real and predicted data.
Figure 3C:
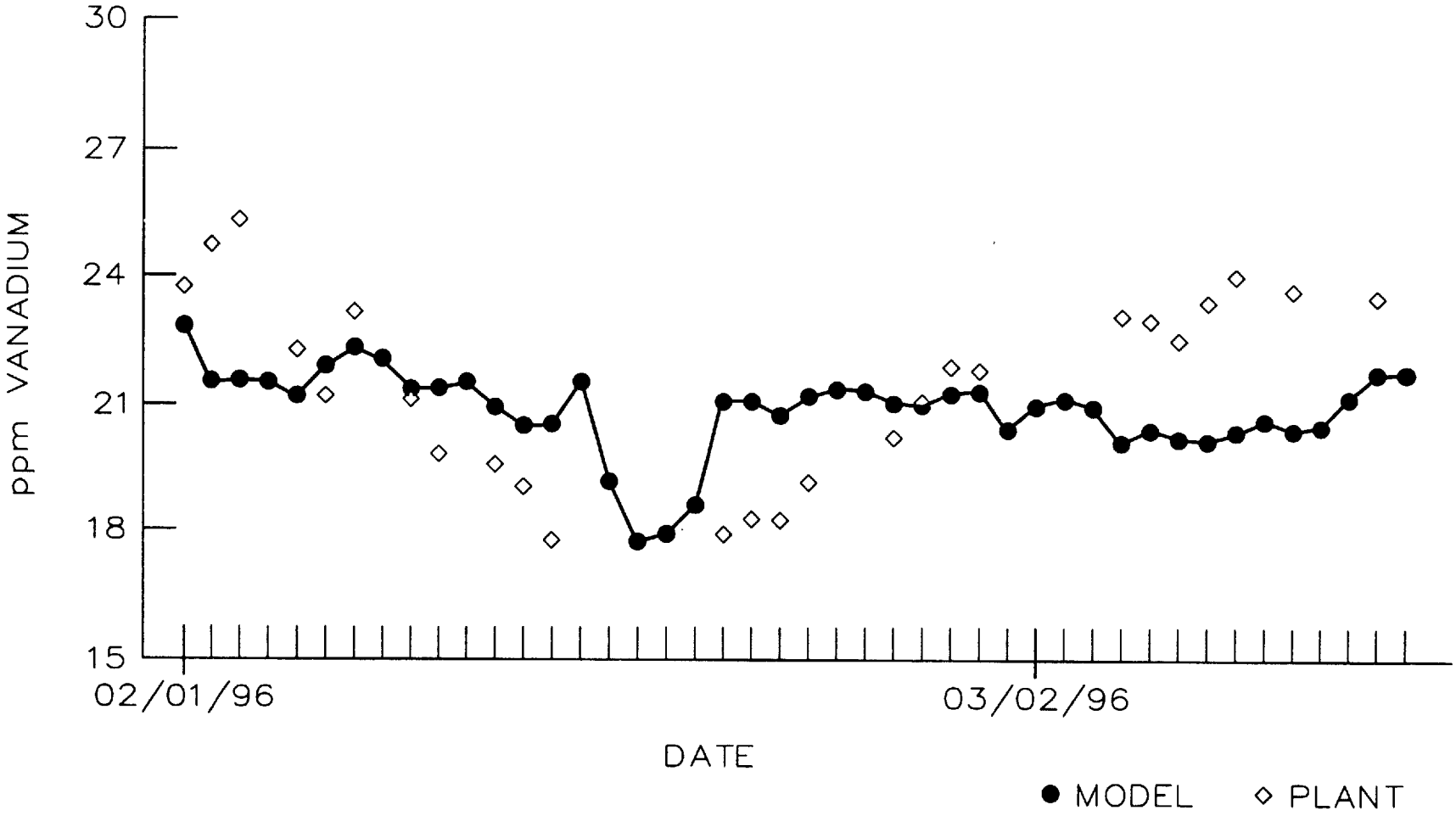
Figure 3D:
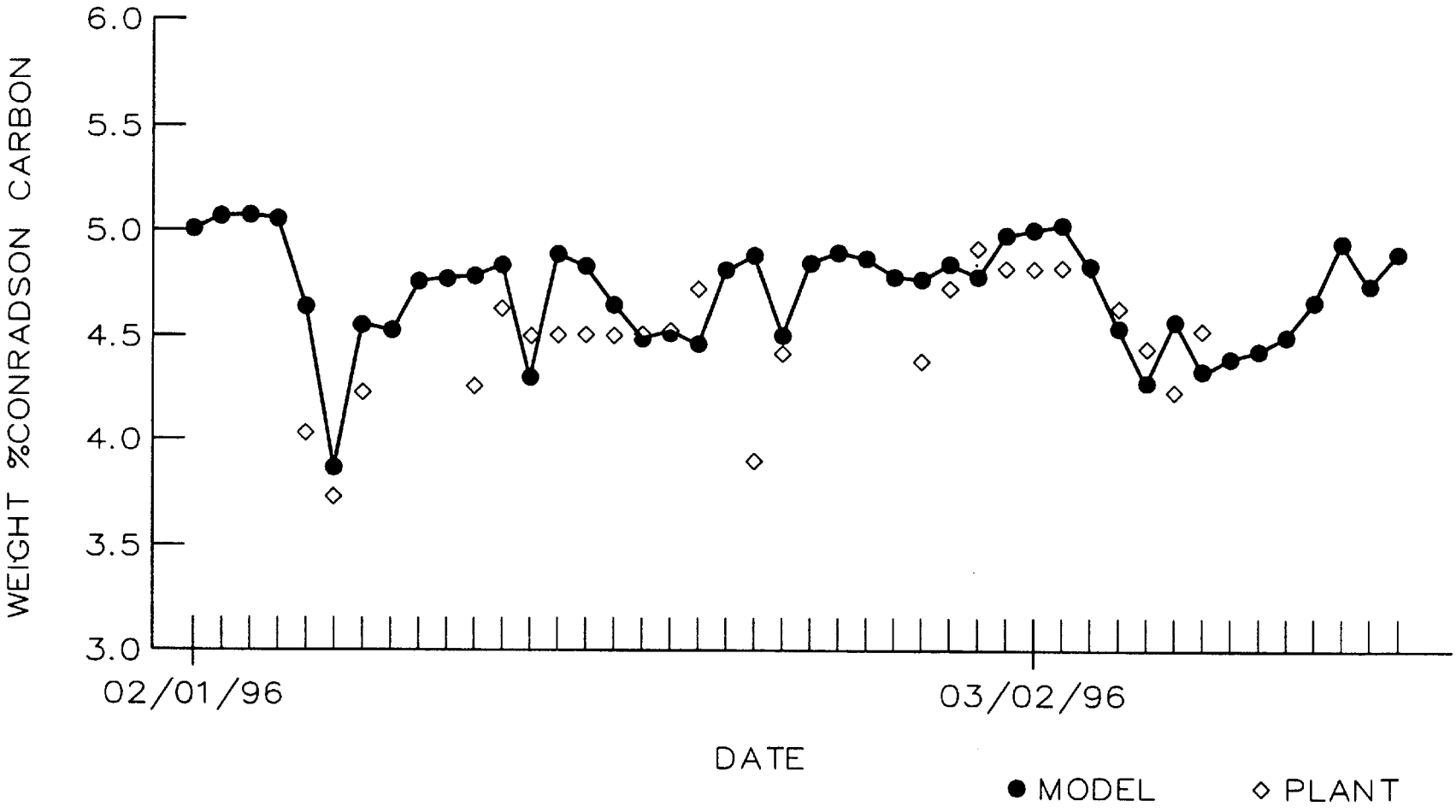
Figure 3E:
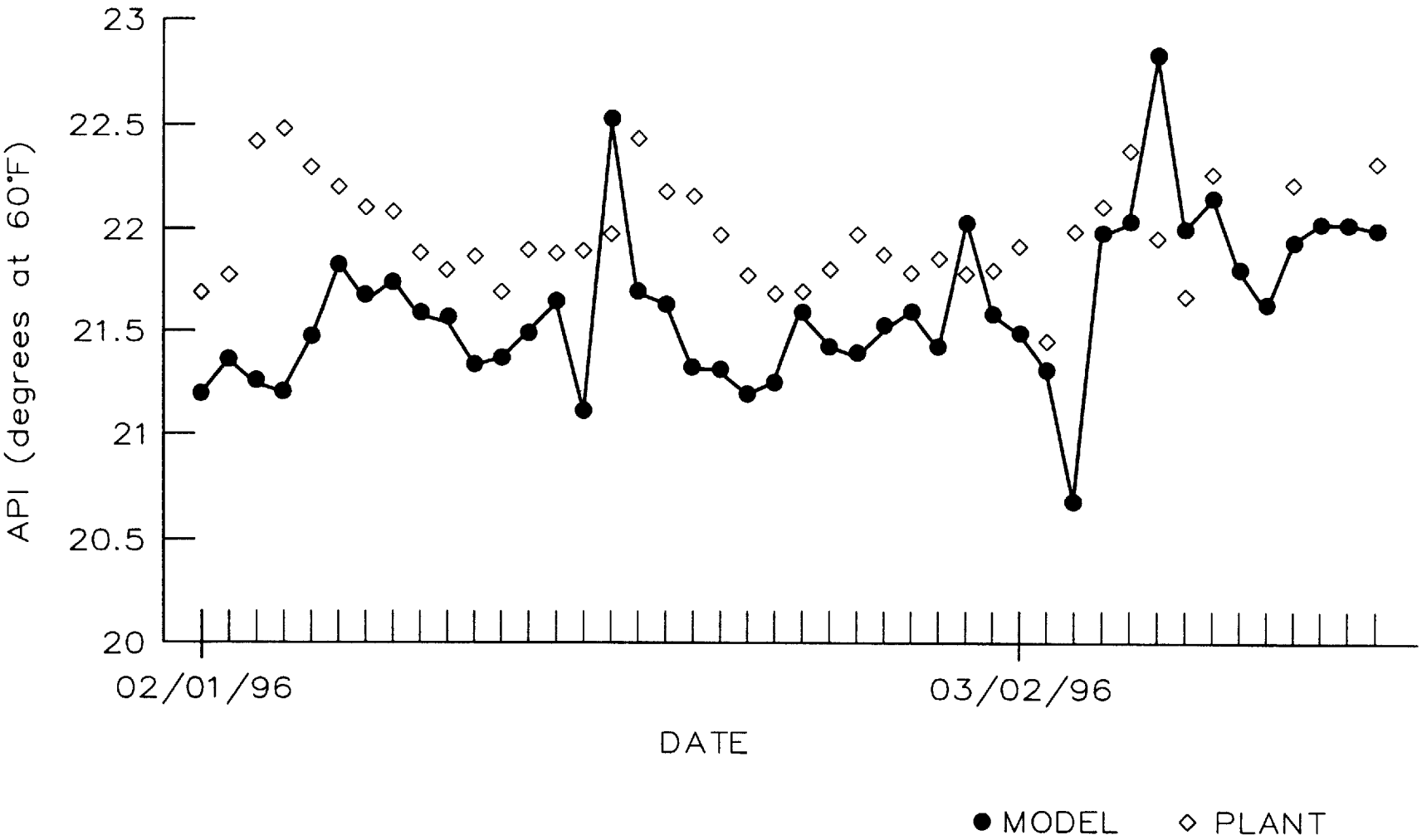

Referring now specifically to FIG. 2, the simulation program according to this invention is made operational at a start step 40 in response to an operator entered command. The simulation routine first reads in user input information and properties of the selected residuum at step 41. An example file corresponding to a feedstock known as North Cowden Sour (NCS) residuum is illustrated in Table II. Nomenclature of the names shown in Table II, as well as the names used in all subsequent tables and examples is illustrated in Appendix 1. Next the routine retrieves information including relevant kinetic and physical property data from a data base according to the criteria specified in the user input file, to access only needed information. For example, the data base may contain physical property and reaction kinetics data for twenty-five or more different residuum oil fractions. However, a desired simulation is usually for a single residual fraction, or alternately for a feedstock obtained from a mixture of two or more selected residuum fractions. At step 42 in FIG. 2, selected kinetic data, which is illustrated in Table III, is entered into the simulation program from the data base. It is noted that the numerical values for kinetic parameters and physical properties as given in Tables II and III, which are used in following examples, are

TABLE II

USER INPUT FILE

| Parameter | Value | Parameter | Value |
|---|---|---|---|
| N_OIL | 1 | $V_{CAT}$ | 44,268.0 |
| ACR_OIL | NCS | $H_2$_SCFB | 3,554.5 |
| PRO_OIL | 100 | $(T_{50\%})_{FEED}$ | 894.0 |
| $(API)_{FEED}$ | 17.5 | $(T_{40\%})_{FEED}$ | 840 |
| $(\%S)_{FEED}$ | 2.3089 | $(T_{30\%})_{FEED}$ | 788 |
| $(\%CCR)_{FEED}$ | 5.75 | $(T_{20\%})_{FEED}$ | 739 |
| $(V_PPM)_{FEED}$ | 21.7 | $(T_{10\%})_{FEED}$ | 691 |
| $(Ni_PPM)_{FEED}$ | 9.49 | $(T_{5\%})_{FEED}$ | 666 |
| $(BN_PPM)_{FEED}$ | 630 | $(T_{IBP})_{FEED}$ | 622 |
| $(BPD)_{FEED}$ | 60,615 | $(\%\ H)_{FEED}$ | 11.46 |
| $T_{WAB}$ | 760 | $(\%MOC)_{PREV}$ | 1.27 |
| ΣBBL | $7.5 \times 10^6$ | $M_{CAT}$ | $1.524 \times 10^6$ |
| $p_W$ | 0 | Δday | 1.0 |
| p | 2297 + 14.7 | | |

TABLE III

KINETIC DATA BASE

| Parameter | Value | Parameter | Value |
|---|---|---|---|
| $(MAX_BBL)_S$ | $6.5 \times 10^7$ | $B_S$ | 0.233 |
| $(MAX_BBL)_{Ni}$ | $5.0 \times 10^7$ | $B_{Ni}$ | 0.233 |
| $(MAX_BBL)_V$ | $5.0 \times 10^7$ | $B_V$ | 0.233 |
| $(MAX_BBL)_{CCR}$ | $9.5 \times 10^7$ | $B_{CCR}$ | 0.233 |
| $(MAX_BBL)_H$ | $1.4 \times 10^8$ | $B_H$ | 0.233 |
| $k_S^N$ | 0.885 | $q_S^{SV}$ | 0.7 |
| $k_{Ni}^N$ | 0.59 | $q_{Ni}^{SV}$ | 0.6 |
| $k_V^N$ | 0.95 | $q_V^{SV}$ | 0.6 |
| $k_{CCR}^N$ | 0.3996 | $q_{CCR}^{SV}$ | 0.6 |
| $k_H^N$ | 0.037 | $q_H^{SV}$ | 0.6 |
| $k_S^I$ | 1.95 | $q_S^{H2S}$ | 0.0925 |
| $k_{Ni}^I$ | 0.95 | $q_{Ni}^{H2S}$ | 0.02 |
| $k_V^I$ | 1.30 | $q_V^{H2S}$ | 0.02 |
| $k_{CCR}^I$ | 0.444 | $q_S^W$ | 7.0 |
| $k_H^I$ | 0.049 | $q_{CCR}^W$ | 0.7 |

for a particular residuum fraction which as previously mentioned is known as NCS, and are given for illustration only. Accordingly, these data values are not intended to be applicable to hydrotreating reactions in general.

Having the kinetic and physical property data for the reactants, and the operating conditions for the reactor, the simulation routine proceeds to step 44 where the liquid hourly space velocity (LHSV) is calculated according to the following equation:

$$LHSV=(BPD)_{FEED}\times 5.615/V_{CAT}/24$$

Evaluating the above equation for $(BPD)_{FEED}$=60,615 bbl/day (from Table II), and $V_{CAT}$=44,268 $ft^3$ (from Table II), gives $$LHSV=0.3203\ h^{-1}$$

Next at step 46 contaminant levels for ARDS effluent and the change in contaminant levels are computed as illustrated in Examples 2 through 4. Typical values for the computed properties, which assume hydrotreatment of residuum obtained from a specific crude oil known as North Cowden Sour (NCS), are given in the examples. Thus, these calculations provide the user with valuable information concerning results to be expected in hydrotreating the residuum oil.

Then at step 48, the production of light hydrocarbon gases such as $C_1$ (methane) to $C_5$ (pentane isomers) are computed as illustrated in Example 5. Example 6 illustrates computing of the hydrogen mass rate consumed in light hydrocarbon gas make, with chemical hydrogen incorporation illustrated in Example 7, and chemical hydrogen consumption in Example 8.

At step 50 in FIG. 2, effluent quantities and physical properties of the ARDS effluent are computed as illustrated in Examples 8 and 9, with further calculation of a distillation curve as illustrated in Example 10. Then at step 52, calculation of basic nitrogen in the ARDS effluent is illustrated in Example 11, calculation of cumulative metals is illustrated in Example 12. The mass balance is maintained as part of the product mass rate computations (Example 8).

FIGS. 3(*a*) through 3(*e*) are computer generated graphs which more clearly illustrate the computational capacity of the ARDS model. These graphs compare ARDS model predictions with real refinery data obtained from a commercial size ARDS reactor. The residuum oil hydrotreated for the period illustrated in FIG. 3 was the residuum from a mixture of three oils including: 83 kBPD Arabian Light, 42 kBPD Venezuelan Mesa 30, and 30 kBPD Alaskan North Slope, where kBPD is thousands of barrels feed per day.

EXAMPLE I

This example describes determining properties of a residuum fraction being considered for hydrotreating, and determining of the actual product parameters of the hydrotreated residuum. The thus determined actual properties are then compared with properties predicted according to this invention.

A sample of desalted Arabian light 650+ °F. residuum was hydrotreated in a laboratory trickle bed reactor. A description in the laboratory experimental apparatus is detailed in a symposium paper, H. D. Johnston, et al., "An Integrated Testing Facility for Bench Scale Catalyst Research.", ACS Meeting, Aug. 28, 1983, Washington, D.C. incorporated herein by reference. A report of the catalyst, operating conditions and feedstock composition is as follows:

| Catalyst - Commercially Available Hydrotreating Catalyst | |
|---|---|
| weight: | 35.72 grams |
| volume: | 50 cubic centimeters |
| Operating Conditions | |
| Name | Value |
| liquid hourly space velocity (LHSV) | 0.33 $hr.^{-1}$ |
| total pressure (psig): | 2,000 |
| hydrogen inlet gas purity (%): | 99 |
| hydrogen provided per barrel residuum feed (SCF): | 4900 |
| water vapor pressure (psig): | 0 |
| weight avg. temp. (°F.): | 760 |
| hours on stream (hr.): | 1055 |

| Hydrocarbon Analysis | Feedstock | Product (Reactor Effluent) |
|---|---|---|
| Conradson Carbon wt. %: | 8.14 (by ASTM D4530) | 2.69 |
| Refractive Index | 1.539 (by ASTM D1218) | 1.510 |
| Basic nitrogen ppm: | 448 | 229 |
| API: | 16.4° (by ASTM D4052) | 24.7 |
| Hydrogen wt. %: | 11.46 | 12.47 |
| Viscosity @ 210° F. SUS: | 113.3 (by ASTM D445) | 53.0 |
| Sulfur wt. %: | 3.42 | 0.22 |
| Nickel ppm: | 8.30 | 1.60 |
| Vanadium ppm: | 32.95 | 0.45 |
| Distillation Temperature (°F.): | | |
| IBP: | 477 | 305 |
| 5% OFF: | 663 | 499 |
| 10% OFF: | 690 | 590 |
| 20% OFF: | 741 | 667 |
| 30% OFF: | 798 | 712 |
| 45% OFF: | 852 | 761 |
| 50% OFF: | 934 | 814 |
| 60% OFF: | 986 | 872 |
| 61.7% OFF: | 1000 | — |
| 70% OFF: | — | 937 |
| 79% OFF: | — | 1000 |

The above listed product properties were determined using data acquisition and displays provided with the above-mentioned integrated test facility. ASTM methods, however, were used where indicated.

The ARDS hydrotreating model, which is more fully described hereinafter in connection with following examples, was then used to predict product (reactor effluent) properties from input data corresponding to the laboratory experiment. The following results, which compare favorably with the above measured product analysis were obtained:

| Model Prediction | |
|---|---|
| Name | Value |
| Conradson Carbon wt. %: | 2.40 |
| Refractive Index: | 1.50 |
| Basic Nitrogen ppm: | 266 |
| Hydrogen wt. %: | 12.88 |
| Viscosity @ 210° F. SUS: | 69.0 |
| Sulfur wt. %: | 0.18 |
| Ni ppm: | 1.10 |
| Vanadium ppm | 0.22 |

Examples 2 through 12 illustrate the predictive computations of the ARDS model, which can be used to predict a variety of variables for charge stocks that were used in determining the kinetic rate constants, such as those illustrated in Table III. The computed variables for hydrotreated residuum include: wt. % sulfur, ppmw nickel, ppmw vanadium, API, Conradson carbon, viscosity, refractive index, boiling curve, flow rates, ppmw basic nitrogen, and wt. % hydrogen. The nomenclature for all terms used in the examples 2 through 12 is given in Appendix 1. As previously mentioned Table II is an example of user input information, and Table III illustrates normal and initial kinetic data base values for a particular residuum oil to be simulated. It is noted that in Example 2 all of the data needed in evaluating the equations is obtained from Tables II and III. In examples following Example 2, however, values calculated in a prior example are sometimes used in a following example.

EXAMPLE 2

This example illustrates computation of wt. % sulfur in ARDS effluent and the change in wt. % sulfur (S).

The first step calculates a long term catalyst deactivation factor $(LTD)_s$ for sulfur according to the equation:

$$(LTD)_S = 1 - \{\Sigma BBL/(MAX_BBL)_S\}^2$$

evaluated using Table II:

$$(LTD)_s=0.987$$

Next the kinetic rate parameter adjusted for sulfur deactivation is computed according to the equation:

$$k_S^L=\{k_S^N+(k_S^I-k_S^N)\times\exp[-(B_S\times\Sigma BBL/10^6)]\}\times(LTD)_S$$

evaluating using Tables II and III:

$$k_S^L=1.056$$

Then:

$E_A^S$=39,600 BTU/1 bmol; activation energy for desulfurization, and $R_g$=1.987 BTU/1 bmol−°R; universal gas constant.

The kinetic rate parameter is then adjusted for temperature according to the equation:

$$k_S^T=k_S^L\times\exp\left[\left(\begin{matrix}S\\E\\A\end{matrix}/R_g\right)\left(\frac{1}{700+459.7}-\frac{1}{T_{WAB}+459.7}\right)\right]$$

evaluating using Table II:

$$k_S^T=2.460$$

Then:

$$(\%\ S)_{EFF}=[\{(\%\ S)_{FEED}\}^{-0.5}+0.5\times k_S^T\times\{1-q_S^{H2S}\times(\%\ S)_{FEED}/H_{2-SCFB}+q_S^W\times p_W/p\}\times(LHSV)^{-q_{SSV}}]^{-2}$$

evaluating gives:

$$(\%\ S)_{EFF}=0.0872,$$

and change in sulfur is:

$$(\Delta\%\ S)_{RX}=(\%\ S)_{FEED}-(\%\ S)_{EFF}=2.222$$

EXAMPLE 3

This example illustrates the computation for Conradson carbon and the reduction of Conradson carbon (CCR).

The first step calculates a long term catalyst deactivation factor according to the equation:

$$(LTD)_{CCR}=1-\{BBL/(MAX_BBL)_{CCR}\}^2$$

evaluating the above using values from Tables II and III $$(LTD)_{CCR}=0.9938$$

Next the kinetic rate parameter is adjusted for CCR deactivation according to the equation:

$$k_{CCR}^L=\{k_{CCR}^N+(k_{CCR}^I-k_{CCR}^N)\times\exp[-B_{CCR}\times\Sigma BBL/10^6]\}\times(LTD)_{CCR}=0.4048$$

Then:

$E_A^{CCR}$=25,200 BTU/1 bmol; activation energy for CCR, and $R_g$=1.987 BTU/1 bmol−°R; Universal gas constant.

The kinetic rate constant is then adjusted for temperature according to the equation:

$$k_{CCR}^T=k_{CCR}^L\times\exp\left[\left(\begin{matrix}CCR\\E\\A\end{matrix}/R_g\right)\times\left(\frac{1}{700+459.7}-\frac{1}{T_{WAB}+459.7}\right)\right]$$

evaluating the above equation gives:

$$k_{CCR}^T=0.6932$$

Then:

$$(\%\ CCR)_{EFF}=(\%\ CCR)_{FEED}\times\exp[-k_{CCR}^T\{1+(q_{CCR}^W\times p_W/p)\}(LHSV)^{-q_{is\ CCR}SV}]$$

evaluating for $(\%\ CCR)_{EFF}$ gives:

$$(\%\ CCR)_{EFF}=1.457$$

EXAMPLE 4

This example illustrates computing product levels of vanadium (V) and nickel (Ni). The removal kinetics for vanadium and nickel follow exactly the same kinetic scheme using corresponding parameter values given in Tables II and III.

Calculate the catalyst deactivation factor for vanadium removal in the following equation:

$$(LTD)_v=1-\{\Sigma BBL/(MAX_BBL)_v\}^2$$

evaluating gives:

$$(LTD)_V=0.9775$$

Adjust the kinetic rate parameter for catalyst deactivation:

$$k_V^L=\{k_V^N+(k_V^I-k_V^N)\times\exp[-(B_V\times\Sigma BBL/10^6)]\}\times(LTD)_V$$

evaluating gives:

$$k_V^L=0.9882$$

Then:

$E_A$=25,200 BTU/1 bmol; activation energy for metal removal $R_g$=1.987 BTU/1 bmol−°R; universal gas constant.

The kinetic rate parameter is then adjusted for temperature according to the equation:

$$k_V^T=k_V^L\times\exp\left[\left(\begin{matrix}V\\E\\A\end{matrix}/R_g\right)\times\left(\frac{1}{700+459.7}-\frac{1}{T_{WAB}+459.7}\right)\right]$$

evaluating the above equation gives:

$$k_V^T=1.692,\text{ and}$$

$$(V_PPM)_{EFF}=(V_{PPM})_{FEED}\times\exp[-k_V^T(1-q_V^{H2S}(\%\ S)_{FEED}/H_{2-SCFB})\times(LHSV)^{-q_{is\ V}SV}]$$

evaluating gives:

$$(V_PPM)_{EFF}=0.7608$$

Following the same kinetic equations for nickel using corresponding parameters from Table II and III:

$$(\text{Ni_PPM})_{EFF}=1.091$$

EXAMPLE 5

This example illustrates computing the quantity of light hydrocarbon gases produced in hydrotreating the residuum fraction in the ARDS reactor.

The first step calculates terms according to the equations:

$$d=(LHSV)^{0.8}$$

$$Q_F=1-\exp[(-1.6)(\Delta\%\ S)_{RX}]$$

evaluated:

$$d=0.4022 \text{ and } Q_F=0.9714$$

Then:

$$C_1_SCFB=Q_F\times\exp[22.082-(15{,}076/T_{WAB})]/d=22.803$$

for hydrotreating NCS crude residuum $$C_2_SCFB=0.331\times Q_F\times\exp[17.298-(11{,}409/T_{WAB})]/d=7.840$$

for the above residuum $$C_3_SCFB=0.320\times Q_F\times\exp[16.663-(11{,}152/T_{WAB})]/d=5.650$$

for the above residuum $$C_{14}_SCFB=0.20\times Q_F\times\exp[18.574-(13{,}850/T_{WAB})]/d=0.9887$$

for the above residuum $$C_4_SCFB=0.285\times Q_F\times\exp[16.496-(11{,}364/T_{WAB})]/d=3.221$$

for the above residuum $$C_5_SCFB=0.16\times Q_F\times\exp[11.058-(7{,}181/T_{WAB})]/d=1.932$$

for the above residuum

EXAMPLE 6

This example illustrates computing the hydrogen mass rate consumed in light hydrocarbon gas make; and the total mass rate of light hydrocarbon gases produced.

$$H_GM_LB\text{DAY} = (0.4)\times(2.016)\times(BPD)_{\text{FEED}}\times(1/379.4)\times\{C_1_SCFB + C_2_SCFB + C_3_SCFB + C_4_SCFB + C_5_SCFB + C_{14}_SCFB\}$$

$$\text{H_GM_LBDAY}=5{,}466$$

$$C_TOT_LB\text{DAY} = \{(16.04\times C_1_SCFB) + (30.07\times C_2_SCFB) + (44.09\times C_3_SCFB) + (72.15\times C_5_SCFB) + 58.12\times(C_4_SCFB + C_{14}_SCFB)\}\times(BPD)_{\text{FEED}}/379.4$$

$$\text{C_TOT_LBDAY}=197{,}216$$

EXAMPLE 7

This example illustrates computing the chemical hydrogen incorporation into the hydrocarbon and the attendant rise in wt. % hydrogen. The calculation begins with the computation of the catalyst deactivation with respect to hydrogen incorporation by the following equation:

$$(LTD)_H=1-\{\Sigma BBL/(MAX_BBL)_H\}^2$$

$$(\text{LTD})_H=0.9971$$

Next the normal kinetic rate parameter is adjusted for long term catalyst deactivation due to hydrogen consumption according to the following equation.

$$k_H^L=\{k_H^N+(k_H^I-k_H^N)\times\exp[-(B_H\times\Sigma BBL/10^6)]\}\times(LTD)_H$$

evaluated as in the previous examples:

$$k_H^L=0.03898$$

Then:

$E_A^H$=25,000 BTU/1 bmol activation energy for hydrogen $R_g$=1.987 BTU/1 bmol−°R Next the above rate constant is corrected for temperature according to the following equation:

$$k_H^T = k_H^L\times\exp\left[\left(\frac{E_A^H/R_g}{}\right)\left(\frac{1}{700+459.7}-\frac{1}{T_{WAB}+459.7}\right)\right]$$

evaluated:

$$k_H^T=0.06663$$

Then:

$$(\%\ H)_{EFF}=(\%\ H)_{FEED}\times\exp[k_H^T\times(LHSV)^{-q_H SV}]$$

and evaluated:

$$(\%\ \text{H})_{EFF}=13.12$$

$$(\Delta\%\ \text{H})_{RX}=(\%\ \text{H})_{EFF}-(\%\ \text{H})_{FEED}$$

$$(\Delta\%\ \text{H})_{RX}=1.65$$

EXAMPLE 8

This example illustrates computing feed and effluent liquid hydrocarbon mass flow rates and mass removal rate of sulfur via production of hydrogen sulfide. The chemical hydrogen consumption rate is also computed as the sum of the rates of hydrogen going to hydrogen sulfide, hydrogen incorporated into the liquid hydrocarbon and hydrogen going toward the production of light hydrocarbon gases. The quantites are obtained according to the following sequence of equations:

To obtain the liquid hydrocarbon feed mass flow rate:

$$(SG)_{FEED}=141.5/[131.5+(API)_{FEED}]=0.94966$$

$$(LBDAY)_{FEED}=(BPD)_{FEED}\times350.1607\times(SG)_{FEED}=2.0157\times10^7$$

Then, to obtain the liquid hydrocarbon effluent mass flow rate, accounting for the various component reductions due to reactions:

$$A=1-(0.01)(\%\ H)_{FEED}-(0.01)(\%\ S)_{FEED}-(10^{-6})[(Ni_PPM)_{FEED}+(V_PPM)_{FEED}]$$

$$B=1-(0.01)(\%\ H)_{EEF}-(0.01)(\%\ S)_{EFF}-(10^{-6})[(Ni_PPM)_{EFF}+(V_PPM)_{EFF}]$$

$$(LBDAY)_{EFF}=\{A\times(LBDAY)_{FEED}-[(C_TOT_LBDAY)-(H_GM_LBDAY)]\}B$$

Then, evaluating:

$$(\mathrm{LBDAY})_{EFF}=1.9805\times10^{7}$$

Then, sulfur removal, $H_2S$ production, and hydrogen going to $H_2S$ mass rates are:

$$(S_LBDAY)=\{(\%\ S)_{FEED}(LBDAY)_{FEED}-(\%\ S)_{EFF}(LBDAY)_{EFF}\}/100(\mathrm{S_LBDAY})=4.481\times10^{5}$$

$$(\mathrm{H_2S_LBDAY})=(\mathrm{S_LBDAY})\times(34.08/32.064)(\mathrm{H_2S_LBDAY})=4.763\times10^{5}$$

$$(\mathrm{H_HDS_LBDAY})=(\mathrm{H_2S_LBDAY})\times(2.016/34.08)(\mathrm{H_HDS_LBDAY})=2.8175\times10^{4}$$

The mass rate of hydrogen incorporation is then found by:

$$(H_INC_LBDAY)=\{(LBDAY)_{EFF}(\%\ H)_{EFF}-(LBDAY)_{FEED}(\%\ H)_{FEED}\}/100\ (\mathrm{H_INC_LBDAY})=2.889\times10^{5}$$

The chemical hydrogen consumption is estimated as the sum of three contributions, here expressed as mass rates:

$$(H_CHC_LBDAY)=\mathrm{H}_INC_LBDAY+H_HDS_LBDAY+H_GM_LBDAY(\mathrm{H_CHC_LBDAY})=3.226\times10^{5}$$

EXAMPLE 9

This example illustrates predicting physical properties of the hydrotreated effluent.

The specific gravity of the feed is adjusted for desulfurization effect according to the equation:

$$SG_HDS=(SG)_{FEED}\times[1-(\Delta\%\ S)_{RX}/100]$$

$$\mathrm{SG_HDS}=0.92856$$

Next the adjusted specific gravity is converted to API gravity according to the equation:

$$API_HDS=(141.5/SG_HDS)-131.5$$

$$\mathrm{API_HDS}=20.90$$

Then the hydrogen incorporation rate is computed according to the equation:

$$H_INC_SCFB=H_INC_LBDAY\times379.4/[2.016\times(BPD)_{FEED}]$$

$$\mathrm{H_INC_SCFB}=897.2$$

Then the change in API due to hydrogen incorporation, and API of ARDS effluent are computed according to the equations:

$$\Delta API_HINC=H_INC_SCFB/(900-T_{WAB})$$

$$\Delta\mathrm{API_HINC}=6.45$$

$$(API)_{EFF}=API_HDS+\Delta API_HINC$$

$$(\mathrm{API})_{EFF}=27.35$$

and, $$(\mathrm{SG})_{EFF}=141.5/[131.5+(API)_{EFF}]$$

$$(\mathrm{SG})_{EFF}=0.8907$$

The refractive index is computed as follows:

$$(RI)_{EFF}=1.5498-0.00192(API)_{EFF}+0.00187\ (\%\ CCR)_{EFF}$$

$$(\mathrm{RI})_{EFF}=1.500$$

Next the viscosity (at 210° F.) of the hydrotreated effluent is calculated according to the following equation:

$$(cP)_{EFF}=\exp[0.172\times(SG)_{EFF}\times(\%\ CCR)_{EFF}+2.1]$$

$$(\mathrm{cP})_{EFF}=10.208$$

$$(cSt)_{EFF}=(cP)_{EFF}/(SG)_{EFF}$$

$$(\mathrm{cSt})_{EFF}=11.46$$

and, the same in Saybolt universal seconds (SUS) at 210° F. is computed:

$$(SUS_210)_{EFF}=\{(cSt)_{EFF}+[(cSt)_{EFF}^{2}+115.703]^{0.5}\}/0.4316$$

$$(\mathrm{SUS_210})_{EFF}=62.97$$

EXAMPLE 10

This example illustrates distillation curve computations for the ARDS reactor effluent.

The first step calculates the position of the feed distillation-curve function on the temperature (°F.) axis according to the equation:

$$XPOS_FD=(T_{50}\%)_{FEED}+25$$

evaluated:

$$\mathrm{XPOS_FD}=919$$

The position of a hydrocracking component to the effluent distillation-curve function is calculated according to the equation:

$$XPOS_HYD=XPOS_FD-25.5-\exp[(T_{WAB}-725)/47.5]$$

evaluated:

$$\mathrm{XPOS_HYD}=865.722$$

Likewise for desulfurization and aromatic hydrogenation component functions:

$$XPOS_SUL=XPOS_HYD-170=695.722$$

$$XPOS_ARO=XPOS_HYD-50=815.722$$

Next the heights corresponding to a weight-fraction-boiled-off axis are calculated for desulfurization, aromatic hydrogenation and hydrocracking component functions as follows:

$$HGT_SUL=[525/32.06]\times(\Delta\%\ S)_{RX}/100=0.364$$

$$\mathrm{HGT_SUL}=0.364$$

$$HGT_ARO=0.32\times\{(\%\ H)_{EFF}-\{(\%\ H)_{FEED}/[1-0.01\times(\Delta\%\ S)_{RX}]\}\}$$

$$\mathrm{HGT_ARO}=0.448$$

$$HGT_HYD=1-(HGT_SUL)-(HGT_ARO)$$

$$\mathrm{HGT_HYD}=0.188$$

Then, a width factor (in °F.) for hydrocracking is calculated according to the following equation; for desulfurization and hydrogenation effects the same width is applied:

$$WDT_HYD=0.44\times[(T_{50\%})_{FEED}-(T_{IBP})_{FEED}]+95$$

$$WDT_HYD=214.68$$

Then, the three component distribution functions are completely defined:

$$COM_HYD=(HGT_HYD)\times\exp[-\{(TBP-XPOS_HYD)/WDT_HYD\}^2]$$

$$COM_SUL=(HGT_SUL)\times\exp[-\{(TBP-XPOS_SUL)/WDT_SUL\}^2]$$

$$COM_ARO=(HGT_ARO)\times\exp[-\{(TBP-XPOS_ARO)/WDT_ARO\}^2]$$

evaluating above three equations for TBP from TBP=50°, 51°, 52° . . . 1100° F. and computing a sum for each boiling point (TBP) gives:

| TBP (F) | A COM HYD | B COM SUL | C COM ARO | SUM A, B, C | CUM SUM |
|---|---|---|---|---|---|
| 50 | $1\times10^{-7}$ | $4.28\times10^{-5}$ | $1.34\times10^{-6}$ | $4.424\times10^{-5}$ | $4.424\times10^{-5}$ |
| 51 | $1\times10^{-7}$ | $4.402\times10^{-5}$ | $1.38\times10^{-6}$ | $4.551\times10^{-5}$ | $8.975\times10^{-5}$ |
| 52 | $1.1\times10^{-7}$ | $4.527\times10^{-5}$ | $1.43\times10^{-6}$ | $4.681\times10^{-5}$ | $1.3656\times10^{-4}$ |
| 300 | $1.802\times10^{-4}$ | $1.216\times10^{-2}$ | $1.398\times10^{-3}$ | $1.374\times10^{-2}$ | 0.7025 |
| 600 | 0.0405 | 0.2980 | 0.1635 | 0.502 | 55.0 |
| 800 | 0.1709 | 0.2871 | 0.4463 | 0.904 | 206.8 |
| | | | | | $(\Sigma)_m = 366$ |

Next normalize CUM_SUM by $(\Sigma)_m$ and retain the terms for TBP<1000° F.; Then: each [CUM_SUM/$(\Sigma)_m$] is the weight fraction off at the given TBP. For example, from the above table at 800° F. the weight fraction boiled off is 206.8/366=0.57. Interpolate using the discrete (TBP, weight fraction off) pairs to get neat break points with respect to weight fraction off. This yields the following distillation curve, representative of an estimate of Simdist ASTM 5307.

| Wt. Fraction Off | TBP (°F.) |
|---|---|
| IBP = $5\times10^{-3}$ | 340.9 |
| .05 | 496.9 |
| .10 | 558.2 |
| .15 | 599.5 |
| .20 | 632.3 |
| .25 | 660.4 |
| .30 | 685.6 |
| .35 | 708.9 |
| .40 | 730.9 |
| .45 | 752.2 |
| .50 | 772.9 |
| .55 | 793.6 |
| .60 | 814.5 |
| .65 | 835.9 |
| .70 | 858.2 |
| .75 | 882.0 |
| .80 | 908.0 |
| .85 | 937.4 |
| .90 | 972.8 |

EXAMPLE 11

This example illustrates computing the basic nitrogen in the ARDS effluent using the following equation. It is an empirical correlation of plant data, and not related to the kinetic equations for removal of other heteroatoms (S, V, Ni) as described in previous examples:

$$(BN_PPM)_{EFF} = -227.09 + 0.99534 \times (T50\%)_{EFF}/3 + 0.162287 \times (BN_PPM)_{FEED} + 4.5668 \times (GPM)_W + 19.9536 \times (Ni_PPM)_{FEED}$$

evaluated:

$$(BN_PPM)_{EFF}=320.76$$

EXAMPLE 12

This example illustrates computation of cumulative metal deposition on the catalyst according to the equation:

$$(\%\ MOC)_{NEW} = \{(0.01)\ (\%\ MOC)_{PREV}\ (M)_{CAT} - (LBDAY)_{EFF}\ [(Ni_PPM)_{EFF} + (V_PPM)_{EFF}]/10^6 + (LBDAY)_{FEED}\ [(Ni_PPM)_{FEED} + (V_PPM)_{FEED}]/10^6\}/\{(0.01)\ (M)_{CAT}\}$$

$$(\%\ MOC)_{NEW} = 1.309$$

While the invention has been described in terms of the presently preferred embodiment, reasonable variations and modifications are possible by those skilled in the art, and such modifications and variations are within the scope of the described invention and the appended claims.

APPENDIX 1

| NOMENCLATURE | |
|---|---|
| $(MAX_BBL_i)_{i-S,V,Ni,CCR,H}$ | Kinetic oil data base parameter for maximum barrels flow over bed for complete deactivation. For property i = S (sulfur), V (vanadium), Ni (nickel), CCR (Conradson carbon), H (hydrogen incorporation) |
| $(k_i^N)_{i-S,Ni,V,CCR,H}$ | Normal kinetic rate parameter for the property i, from kinetic oil data base |
| $(k_i^I)_{i-S,Ni,V,CCR,H}$ | Initial kinetic rate parameter for the property i, from kinetic oil data base |
| $(B_i)_{i-S,Ni,V,CCR,H}$ | Transitional deactivation parameter for property i, from kinetic oil data base |
| $(q_i^{SV})_{i-S,Ni,V,CCR,H}$ | Power on the space velocity term in the kinetic equation for property i, from kinetic oil data base |
| $(q_i^{H2S})_{i-S,Ni,V}$ | Coefficient for the hydrogen sulfide term in the kinetic equation for property i, from kinetic oil data base |
| $(q_i^W)_{i-S,CCR}$ | Coefficient for the water term in the kinetic equation for property i, from the kinetic oil data base |
| $(BPD)_{FEED}$ | Barrels per day feed rate of liquid hydrocarbon to ARDS |
| $V_{CAT}$ | Volume of ARDS catalyst at start of run (SOR) in $ft^3$ |
| LHSV | Liquid hourly space velocity ($hr^{-1}$) |
| N_OIL | Number of oils of different origin in the ARDS feed |
| ACR_OIL | Three-character acronyms of the oils in the feed |
| PRO_OIL | Percentages of each of the oils in the feed |
| $(API)_{FEED}$ | API of the ARDS feed |
| $(\%\ S)_{FEED}$ | Weight percent sulfur in the ARDS feed |
| $(V_PPM)_{FEED}$ | Parts per million by weight (ppmw) vanadium in the ARDS feed |
| $(\%\ CCR)_{FEED}$ | Weight percent Conradson carbon in the ARDS feed |
| $(Ni_PPM)_{FEED}$ | ppmw nickel in the ARDS feed |
| $(BN_PPM)_{FEED}$ | ppmw basic nitrogen in the ARDS feed |
| $T_{WAB}$ | Weight-average bed temperature (°F.) |
| ΣBBL | Cumulative barrels of feed flow over the ARDS catalyst to date (or equivalent time on stream) |
| $p_W$ | partial pressure of injected water in psi |
| p | ARDS reactor pressure in psi |
| $H_2$_SCFB | Standard $ft^3$ $H_2$ gas feed to the reactor per barrel of hydrocarbon feed |
| $(T_{50\%})_{FEED}$, $(T_{40\%})_{FEED}$, . . . $(T_{IBP})_{FEED}$ | Feed distillation curve temperatures (°F.) for 50% off by wt, 40% off by wt, . . . initial boiling point, or Simdist ASTM 5307 curve |
| $(T_{90\%})_{EFF}$, $(T_{80\%})_{EFF}$, . . . $(T_{IBP})_{EFF}$ | Effluent distillation curve temperatures (°F.) for 90% off by wt, 80% by wt off, . . . initial boiling point, or Simdist ASTM 5307 curve |
| $(\%\ H)_{FEED}$ | wt % hydrogen in ARDS hydrocarbon feed |
| $(\%\ MOC)_{PREV}$ | wt % metals (Ni + V) on catalyst at of beginning of calculation |
| $(\%\ MOC)_{NEW}$ | Updated wt% metals (Ni + V) on catalyst at end of calculation |
| $M_{CAT}$ | Mass of catalyst at start of run (SOR) in lbm |
| Δday | Number of days over which the current conditions hold |
| $(LTD)_{i-S,V,Ni,CCR,H}$ | Long-term deactivation function result for the property i |
| $(k_i^L)_{i-S,V,Ni,CCR,H}$ | Kinetic rate parameter for the property i constructed from fundamental components and adjusted for deactivation |
| $(k_i^T)_{i-S,V,Ni,CCR,H}$ | Kinetic rate parameter for the property i adjusted for temperature by Arrhenius |
| $(E_A^i)_{i-S,V,Ni,CCR,H}$ | Activation energy (Btu/lbmol) for property i reaction type |
| $R_g$ | Gas constant (1.987 Btu/lbmol-R) |
| $(\%\ S)_{EFF}$ | Weight percent sulfur in reactor effluent |
| $(\%\ CCR)_{EFF}$ | Weight percent Conradson carbon in reactor effluent |
| $(V_PPM)_{EFF}$ | ppmw vanadium in reactor effluent |
| $(Ni_PPM)_{EFF}$ | ppmw nickel in reactor effluent |
| $(\Delta\%\ S)_{RX}$ | Change in sulfur wt % |
| $C_1$_SCFB | Methane produced in standard $ft^3$ per barrel |

APPENDIX 1-continued

| NOMENCLATURE | |
|---|---|
| | feed |
| $C_2$_SCFB | Ethane produced in standard $ft^3$ per barrel feed |
| $C_3$_SCFB | Propane produced in standard $ft^3$ per barrel feed |
| $C_{14}$_SCFB | Iso-butane produced in standard $ft^3$ per barrel feed |
| $C_4$_SCFB | Normal butane produced in standard $ft^3$ per barrel feed |
| $C_5$_SCFB | Pentanes produced in standard $ft^3$ per barrel feed |
| H_GM_LBDAY | Rate of hydrogen mass consumed in light hydrocarbon gas make, in lbm/day |
| C_TOT_LBDAY | Total mass rate of light hydrocarbon gases produced in lbm/day |
| $(SG)_{FEED}$ | Specific gravity of ARDS feed |
| $(LBDAY)_{FEED}$ | ARDS liquid hydrocarbon feed flow rate in lbm/day |
| $(\% H)_{EFF}$ | Weight percent hydrogen in ARDS effluent |
| $(LBDAY)_{EFF}$ | ARDS liquid hydrocarbon effluent flow rate in lbm/day |
| (S_LBDAY) | Sulfur rate of removal in lbm/day |
| ($H_2S$_LBDAY) | Hydrogen sulfide rate of production in lbm/day |
| (H_HDS_LBDAY) | Hydrogen consumption rate going to hydrogen sulfide, in lbm/day |
| (H_INC_LBDAY) | Hydrogen incorporation rate in lbm/day |
| (H_CHC_LBDAY) | Chemical hydrogen consumption in lbm/day |
| (H_CHC_SCFB) | Chemical hydrogen consumption in standard $ft^3$ per barrel feed |
| SG_HDS | ARDS feed specific gravity adjusted for desulfurization effect |
| API_HDS | SG_HDS converted to API gravity |
| H_INC_SCFB | Hydrogen incorporation in terms of standard $ft^3$ per barrel feed |
| ΔAPI_HINC | Change in fluid API due to hydrogen incorporation |
| $(API)_{EFF}$ | API of the ARDS reactor effluent |
| $(RI)_{EFF}$ | Refractive index at 20° C. of the ARDS reactor effluent |
| $(cP)_{EFF}$ | Viscosity in centipoise of the reactor effluent at 210° F. |
| $(cSt)_{EFF}$ | Viscosity in centistokes of the reactor effluent at 210° F. |
| (SUS_210)_EFF | Viscosity in Saybolt universal seconds at 210° F. of the reactor effluent |
| $(GPM)_W$ | gallons per minute injection rate of water to ARDS |
| $(BN_PPM)_{EFF}$ | Basic nitrogen (ppmw) in ARDS effluent |
| $(\Delta\% H)_{RX}$ | Change in wt % H of ARDS fluid due to hydrogen incorporation |
| TBP | Temperatures (°F.) input to compose the distillation curve, evaluated at 50, 51, . . . 1100 |
| XPOS_FD | Position of the feed (input) function for the distillation curve on the temperature (independent) axis in °F. |
| XPOS_HYD | Position of the hydrocracking component function on the temperature (independent) axis in °F. |
| XPOS_SUL | Position of the desulfurization component function on the temperature (independent) axis in °F. |
| XPOS_ARO | Position of the hydrogenation component function on the temperature (independent) axis in °F. |
| HGT_HYD;_SUL;_ARO | Heights of the hydrocracking, desulfurization and hydrogenation component functions; have unit of weight fraction of reactor effluent off |
| WDT_HYD;_SUL;_ARO | Widths of the hydrocracking, desulfurization and hydrogenation component functions; have units of °F. |
| $(\Sigma)_m$ | Final cumulative value of the unnormalized ARDS product distillation curve |
| CUM_SUM | Unnormalized results of the ARDS product distillation curve |
| Wt_Fraction_Off | Normalized values of distillation curve in terms of weight fraction off at a given TBP. |

That which is claimed is:

1. A method for enhancing selection of a crude oil for future processing in a refinery, wherein the future crude oil is selected from a plurality of candidate crude oils containing sulfur, metal, and Conradson carbon contaminants, and wherein selection of an economical future crude oil for processing in said refinery is enhanced with the aid of a computer programmed for simulating a reaction for hydrotreating residuum oil fractions of said plurality of candidate crude oils in a reactor, said method comprising:

(a) providing said computer with a data base for said plurality of candidate crude oils, said data base including at least:

i) a set of reaction kinetics parameters unique to a residuum oil fraction for each of said plurality of candidate oils;

ii) a set of residuum oil properties, unique to each of said plurality of candidate oils;

(b) providing said computer with a mathematical model for use in said method, said model comprising a group of equations for predicting at least product yields and levels of contaminants of a hydrotreated residuum oil fraction, wherein said hydrotreated residuum oil is a reaction product of said reactor;

(c) selecting at least one of said residuum oil fractions to provide a selected residuum oil fraction for simulation in said computer;

(d) retrieving said set of reaction kinetics parameters, and said set of residuum oil properties from said data base for said selected residuum fraction, and providing said computer with desired operating conditions for said reaction for hydrotreating;

(e) computing adjusted reaction kinetics parameters, wherein said set of reaction kinetics parameters are adjusted for at least reactor conditions and catalyst deactivation;

(f) using said adjusted reaction kinetics parameters in said group of model equations for predicting at least product yields and levels of contaminants in said hydrotreated residuum oil fractions; and (g) repeating steps (c) through (f) for a desired number of said residuum oil fractions, wherein selection of a desired crude oil for future processing in said refinery is guided by simulation of said reaction for hydrotreating.

2. A method in accordance with claim 1, additionally comprising:

computing in said computer the chemical hydrogen consumption in said reaction for hydrotreating.

3. A method in accordance with claim 2, wherein the hydrogen consumption is said reaction for hydrotreating is the sum of the hydrogen required for:

i) light hydrocarbon gases produced, ii) the hydrogen incorporated in the reactor effluent, and iii) the hydrogen required for the hydrogen sulfide gas produced.

4. A method in accordance with claim 1, wherein said predicted level of contaminants for said hydrotreated residuum oil fractions includes at least one contaminant selected from the group of contaminants consisting of:

vanadium, nickel, sulfur,

Conradson carbon, and basic nitrogen.

5. A method in accordance with claim 1, wherein said predicted product yields include at least one product yield selected from the group of products consisting of:

liquid hydrocarbons, sulfur, hydrogen sulfide, and light hydrocarbon gases.

6. A method in accordance with claim 1, additionally comprising computing in said simulation the value of at least one physical property of said hydrotreated residuum oil fraction, wherein said physical property is selected from the group of physical properties consisting of:

viscosity, refractive index, distillation curve, and

API gravity.

7. A method in accordance with claim 1, wherein said set of residuum oil properties include the properties of crude oil topped in an atmospheric distillation column.

8. A method in accordance with claim 1, wherein said set of reaction kinetics parameters are determined experimentally in a laboratory scale trickle bed reactor.

9. A method in accordance with claim 1, wherein said group of equations for predicting levels of contaminants includes the following equation for predicting levels of sulfur in said hydrotreated residuum oil fractions:

$$(\%\ S)_{EFF}=[\{(\%\ S)_{FEED}\}^{-0.5}+0.5\times k_S^T\times\{1-q_S^{H2S}(\%\ S)_{FEED}/H_2_SCFB+q_S^W P_W/p\}\times(LHSV)^{-q_S^{SV}}]^{-2}$$

where $(\%\ S)_{EFF}$ is weight percent sulfur in reactor effluent, $(\%\ S)_{FEED}$ is weight percent sulfur in reactor feed, $k_S^T$ is kinetic rate parameter for sulfur adjusted for temperature by an Arrhenius equation, $q_S^{H2S}$ is the kinetic coefficient for the hydrogen sulfide term in the in the kinetic equation for sulfur removal, $H_2$_SCFB is the standard cubic feed hydrogen in the reactor per barrel of hydrocarbon feed, $q^{W_S}$ is coefficient for a water term in the kinetic equation for sulfur removal, $p_W$ is the partial pressure of injected water in psi, p is reactor pressure in psi, LHSV is the liquid hourly space velocity, $hr^{-1}$, $q_S^{SV}$ is the power on the space velocity term in the kinetic equation for sulfur removal.

10. A method in accordance with claim 1, wherein said group of equations for predicting levels of contaminants includes the following equation for predicting levels of vanadium in said hydrotreated residuum oil fraction:

$$(V_PPM)_{EFF}=(V_PPM)_{FEED}\times\exp[-k_V^T(1-q_V^{H2S}(\%\ S)_{FEED}/H_2_SCFB)\times(LHSV)^{-q_{is\ V}^{SV}}]$$

where $(V_PPM)_{EEF}$ is part per million by weight (ppmw) vanadium in reactor effluent, $(V_PPM)_{FEED}$ is ppmw vanadium in reactor feed, $k_V^T$ is the kinetic rate parameter for vanadium removal adjusted for temperature by the Arrhenius equation, $q_V^{H2S}$ is the coefficient for the hydrogen sulfide term in the kinetic equation for vanadium removal, $(\%\ S)_{FEED}$ is the weight percent in the reactor feed next line H2_SCFB is standard cu.ft. hydrogen in the reactor per barrel of hydrocarbon feed, (LHSV) is the liquid hourly space velocity, $hr^{-1}$, $q_V^{H2S}$ is the coefficient for the hydrogen sulfide term in the kinetic equation for vanadium removal.

11. A method in accordance with claim 1, wherein ppmw nickel in the reactor effluent is computed according to an equation of the same form as the equation for vanadium removal recited in claim 10.

12. A method in accordance with claim 1, wherein said group of equations for predicting product yields includes the following equations for predicting a liquid hydrocarbon yield from said reactor:

$$A=1-(0.01)(\%\ H)_{FEED}-(0.01)(\%\ S)_{FEED}-(10^{-6})[(N_i_PPM)_{FEED}+(V_PPM)_{FEED}]$$

$$B=1-(0.01)(\%\ H)_{EEF}-(0.01)(\%\ S)_{EFF}-(10^{-6})[(N_i_PPM)_{EFF}+(V_PPM)_{EFF}]$$

$$(LBDAY)_{EFF}=\{A\times(LBDAY)_{FEED}-[(C_TOT_LBDAY)-(H_GM_LBDAY)]\}/B$$

where:

$(\%\ H)_{FEED}$ is weight percent hydrogen in feed, $(\%\ S)_{FEED}$ is weight percent sulfur in feed, $(N_i_PPM)_{FEED}$ is ppmw nickel in feed, $(V_PPM)_{FEED}$ is ppmw vanadium in feed, $(\%\ H)_{EFF}$ is weight percent hydrogen in effluent, $(\%\ S)_{EFF}$ is weight percent sulfur in effluent, $(N_i_PPM)_{EFF}$ is ppmw nickel in effluent, $(V_PPM)_{EFF}$ is ppmw in vanadium effluent, $(LBDAY)_{EFF}$ is the reactor effluent flow rate, $(LBDAY)_{FEED}$ is the liquid hydrocarbon feed flow rate, (C_TOT_LBDAY) is total mass rate of light hydrocarbon gases produced, (H_GM_LBDAY) is hydrogen mass rate consumed by light hydrocarbon gas make.

13. A method in accordance with claim 3, wherein said group of equations includes the following equation for predicting $C_1$ hydrocarbon gas production:

$$C_1_SCFB=Q_F\times\exp[22.082-(15{,}076/T_{WAB})]/d=22.803$$

for hydrotreating NCS crude residuum where:

$C_1$_SCFB is methane produced in standard cu. ft. per barrel, $Q_F$ is $1-\exp[(-1.6)(\Delta\%\ S)_{RX}]$ $(\Delta\%\ S)_{RX}$ is the change in sulfur weight percent due to reaction; and d is $(LHSV)^{0.8}$.

14. Apparatus for enhancing selection of a crude oil for future processing in a refinery, wherein a future crude oil for processing in said refinery is selected from a plurality of candidate crude oils containing sulfur, metal and Conradson carbon contaminants, and wherein selection of an economical crude oil for future processing is enhanced with the aid of a computer programmed for simulating a reaction for hydrotreating residuum oil fractions of said plurality of candidate crude oils in a reactor, said apparatus comprising:

a said computer programmed according to the following method steps:

(a) providing said computer with a data base for said plurality of candidate crude oils, said data base including at least:

i) a set of reaction kinetics parameters unique to a residuum oil fraction for each of said plurality of candidate oils;

ii) a set of residuum oil properties, unique to each of said plurality of candidate oils;

(b) providing said computer with a mathematical model for use in said method, said model comprising a group of equations for predicting at least product yields and levels of contaminants of a hydrotreated residuum oil fraction, wherein said hydrotreated residuum oil is a reaction product of said reactor;

(c) selecting at least one of said residuum oil fractions to provide a selected residuum oil fraction for simulation in said computer;

(d) retrieving said set of reaction kinetics parameters, and said set of residuum oil properties from said data base for said selected residuum fraction, and providing said computer with desired operating conditions for said reaction for hydrotreating;

(e) computing adjusted reaction kinetics parameters, wherein said set of reaction kinetics parameters are adjusted for at least reactor conditions and catalyst deactivation;

(f) using said adjusted reaction kinetics parameters in said group of model equations for predicting at least product yields and levels of contaminants in said hydrotreated residuum oil fractions; and (g) repeating steps (c) through (f) for a desired number of said residuum oil fractions, wherein selection of a desired crude oil for future processing in said refinery is guided by simulation of said reaction for hydrotreating.

15. Apparatus in accordance with claim 14, additionally comprising:

(a) a laboratory trickle bed reactor for hydrotreating a sample of said residuum oil fraction from each of said plurality of candidate crude oils;

(b) means for measuring a plurality of physical properties of said sample of residuum oil from each of said plurality of candidate crude oils, (c) wherein data obtained in step (b) above comprises said set of residuum oil properties.

16. Apparatus in accordance with claim 15, wherein said plurality of physical properties comprises:

Refractive index,

API, degrees

Viscosity @210° F., Saybolt universal seconds (SUS)

Nickel, ppmw

Vanadium, ppmw, and

Distillation curve, temperature (°F.) vs. weight fraction off.

17. A program storage device, readable by a computer, tangibly embodying a program of instructions executable by said computer to perform method steps for simulating a reaction for hydrotreating residuum oil fractions of a plurality of candidate crude oils in a reactor, said method steps comprising;

(a) providing said computer with a data base for said plurality of candidate crude oils, said data base including at least:

i) a set of reaction kinetics parameters unique to a residuum oil fraction for each of said plurality of candidate oils;

ii) a set of residuum oil properties, unique to each of said plurality of candidate oils;

(b) providing said computer with a mathematical model for use in said method, said model comprising a group of equations for predicting at least product yields and levels of contaminants of a hydrotreated residuum oil fraction, wherein said hydrotreated residuum oil is a reaction product of said reactor;

(c) selecting at least one of said residuum oil fractions to provide a selected residuum oil fraction for simulation in said computer;

(d) retrieving said set of reaction kinetics parameters, and said set of residuum oil properties from said data base for said selected residuum fraction, and providing said computer with desired operating conditions for said reaction for hydrotreating;

(e) computing adjusted reaction kinetics parameters, wherein said set of reaction kinetics parameters are adjusted for at least reactor conditions and catalyst deactivation;

(f) using said adjusted reaction kinetics parameters in said group of model equations for predicting at least product yields and levels of contaminants in said hydrotreated residuum oil fractions; and (g) repeating steps (c) through (f) for a desired number of said residuum oil fractions, wherein selection of a desired crude oil for future processing in said refinery is guided by simulation of said reaction for hydrotreating.

18. A program storage device, in accordance with claim 17, additionally comprising the method step of:

computing in said computer the chemical hydrogen consumption in said reaction for hydrotreating, wherein the chemical hydrogen consumption is the sum of:

i) the hydrogen required for light hydrocarbon gases produced, ii) the hydrogen incorporated in the reactor effluent, and iii) the hydrogen required for the hydrogen sulfide gas produced.

19. A program storage device, in accordance with claim 17, wherein said predicted level of contaminants for each of said plurality of candidate oils includes at least one contaminant selected from the group of contaminants consisting of:

vanadium, nickel, sulfur,

Conradson carbon, and basic nitrogen;

and wherein, said predicted product yields include at least one product selected from the group of products consisting of liquid hydrocarbon, sulfur, hydrogen sulfide, and light hydrocarbon gases.

* * * * *